US005375405A

United States Patent [19]

Weeger

[11] Patent Number: 5,375,405

[45] Date of Patent: Dec. 27, 1994

[54] ROVING FRAME WITH A DEVICE FOR AUTOMATIC REPLACEMENT OF FULL ROVING BOBBINS FOR EMPTY ROVING SLEEVES

[75] Inventor: Hans P. Weeger, Hattenhofen, Germany

[73] Assignee: Zinser Textilmaschinen GmbH, Ebersbach/Fils, Germany

[21] Appl. No.: 116,257

[22] Filed: Sep. 2, 1993

[30] Foreign Application Priority Data

Sep. 2, 1992 [DE] Germany ..... 4229296

[51] Int. Cl.[5] ..... D01H 9/00; D01H 9/10

[52] U.S. Cl. ..... 57/281; 57/67; 57/90; 57/267; 57/273

[58] Field of Search ..... 57/266, 267, 268, 270, 57/273, 274, 281, 90, 67

[56] References Cited

U.S. PATENT DOCUMENTS

| | | | |
|---|---|---|---|
| 3,935,699 | 2/1976 | Iida et al. | 57/267 |
| 4,137,701 | 2/1979 | Herubel | 57/67 X |
| 4,369,621 | 1/1983 | Kogiso | 57/274 X |
| 4,757,679 | 7/1988 | Marzoli | 57/274 X |
| 5,170,616 | 12/1992 | Genevray | 57/267 |
| 5,172,541 | 12/1992 | Schmalz | 57/90 X |
| 5,197,272 | 3/1993 | Frey | 57/281 X |
| 5,222,350 | 6/1993 | Bowman et al. | 57/267 |

FOREIGN PATENT DOCUMENTS

| | | | |
|---|---|---|---|
| 0031844 | 6/1980 | European Pat. Off. . | |
| 23193 | 1/1981 | European Pat. Off. | 57/267 |
| 2751264 | 7/1980 | Germany . | |
| 3936518 | 5/1991 | Germany . | |
| 1201029 | 9/1986 | Japan | 57/274 |
| 61415 | 11/1988 | Japan | 57/267 |

OTHER PUBLICATIONS

H. Stutz, Pfullingen, "Beispielefur Die Atomatisierung Der Spinnereivorbereitung", Textilbetrieb—Sep. 1979, 2 pages.

*Primary Examiner*—Daniel P. Stodola
*Assistant Examiner*—William Stryjewski
*Attorney, Agent, or Firm*—Herbert Dubno; Yuri Kateshov

[57] ABSTRACT

For the simplest possible alterations and only a minimal structure change in a roving frame, on a roving frame one, full bobbins and empty sleeves are transversed to and from a suspension carriage train guided through the flyers on a guide path formed by the flyers into the change position. For this purpose under the heads of the flyers and/or under the flyer bank of the roving frame guide bodies are arranged to provide a guide path for the suspension carriage train along the longitudinal axis of the roving frame in especially transverse positions of the flyers.

17 Claims, 7 Drawing Sheets

ROVING FRAME WITH A DEVICE FOR AUTOMATIC REPLACEMENT OF FULL ROVING BOBBINS FOR EMPTY ROVING SLEEVES

FIELD OF THE INVENTION

The invention relates to a roving frame with a device for automatic replacement of full roving bobbins for empty roving sleeves or cores and, more particularly, to a bobbin-replacement system in the form of suspended carriages with hangers in which the roving bobbins and the roving sleeves are suspended by the lifting movements of a carrier device for the roving bobbins and roving sleeves of the roving frame.

BACKGROUND OF THE INVENTION

In a conventional roving frame of this type (DE 39 36 518 A1) the suspension carriage track is located substantially at the same level as the flyer bank, behind the flyer bank. To re-place the full roving bobbins with empty roving sleeves, the bobbin bank must be shifted from its working position below the flyer bank rearwardly below the transport unit (transporter). That necessitates a significant structural reconfiguration of the roving frame.

The shiftability of the heavy bobbin bank, which is connected via a drive mechanism with the machine frame, by the prescribed distance is very expensive structurally and constructionally. To enable the bobbin bank to be shifted by the prescribed distance, no supports can be provided for the flyer bank in the shifting region, so that the flyer bank which in any event projects, will have to project twice as wide as is customary and is subject to substantially stronger detrimental oscillations and vibrations.

At lower constructional cost is an also conventional solution (EP 0 031 844) in which the flyers of the roving frame can be laterally swung away to enable access from above of a lowerable device with a band studded with suspension holders, to the full bobbins.

OBJECTS OF THE INVENTION

It is the principal object of the invention to so improve a device for the automatic replacement of full roving bobbins by empty roving sleeves on a roving frame of the aforedescribed type, that the indicated drawbacks are avoided.

Another objects is to provide an improved roving frame with automatic replacement of empty sleeves by full bobbins whereby the automatic replacement device occupies less space and interferes less with the construction of the flyer bank than has heretofore been the case.

It is also an object to provide an improved method of operating a roving frame to avoid disadvantages of prior art systems.

SUMMARY OF THE INVENTION

These objects are achieved by providing the flyer bank with means forming a track for the hanger train which runs in the space swept by the flyers, but after the flyers have been brought to standstill. The track-forming means can be provided on the flyer bank or on the flyers themselves. To enable the suspension carriage train to travel in the space swept by the flyer heads and flyer arms, the flyers are preferably oriented transversely to the longitudinal direction.

To make this possible, the guide means can be arranged on the underside of the flyer bank or on the underside of the flyer heads disposed directly under the flyer bank.

In this manner it is possible to ensure that, with a minimum penetration into the structural width of the machine—basically only the height of the flyer must be increased at a distance corresponding to an average by about one hand width of a service person—enabling the possibility of raising and lowering a device in this region carrying the bobbin and the sleeve without manual intervention of the service person, empty spools will be fed to all spinning stations of the roving frame, all full bobbins will be suspended simultaneously from the bobbin bank on the suspension carriage train, and the empty sleeves will be brought from the suspension carriage train to the bobbin receivers in the bobbin bank and the bobbin carriage train moved away, so that the roving frame can be started again after the shortest time.

There are already known (DE 27 51 264) flyers of roving frames which have on the undersides of their heads resilient retaining clamps which can engage in grooves at upper ends of the roving sleeves and draw the full bobbins from the bobbin spindles, when the bobbin bank, after catching of the sleeves, is lowered. The thus engaged full bobbins must then be removed by hand, however. A mounting of the empty sleeves is not provided for with this device. It also requires special sleeves with grooves at their upper ends.

It is also already known (EP 0 023 193) to provide on the underside of the flyer bank of a roving frame grippers swingable on the flyers and which engage the full bobbins at flanges at the upper ends of the bobbin sleeves to swing the engaged full bobbins out from the flyers and enable doffing. Also in this construction the bobbins must be taken off by hand and further handled.

Since the guide paths run through the rotation regions of the flyers in the present invention, the guide means cannot be continuous and positionally fixed.

They can be, according to the invention, positionally fixed on the underside of the flyer bank so that they do not extend through the paths of the flyers when they are rotated, or they can be disposed on the undersides of the heads of the flyers so that they lie within the flyer orbits. In these cases there remain unavoidable larger or small gaps in the guide path.

The guiding of the suspension carriage train can be effected exclusively by the guide means positionally fixed on the flyer bank or exclusively by the guide means located beneath the heads of the flyers when the individual carriages of the suspension carriage train so project, especially in the direction of movement, that they can bridge the gaps in the guide path, especially upon insertion into the flyer row. For this purpose, the carriages must have a minimum length limited by the curvilinear travel and a radius of their guide path outside the roving frame which can be undesirable.

For a practically gapless and especially reliable guidance and retention of a suspension carriage train even with shorter carriages, the elements of the guide means can be fixed on the flyer bank and also can be rotatable with the flyers.

According to the invention, the guide means can be basically so formed, for the suspension carriage trains, as rails upon which support bodies like :rollers or roller pairs or slide bodies of the suspension carriage train can roll or slide or, in a kinematic reversal, which are formed as support bodies like rollers or roller pairs or slide bodies upon which guide channels of the suspension carriage train can roll or slide.

Preferably the guide means are provided as separate rail segments collectively forming however the guide track, which affords the advantage of directionally orienting the suspension carriage train in the prescribed direction of movement. This can be obtained with a fixed mounting of at least some elements of the guide means beneath the flyer bank.

Where guide means are provided in the form of rails on the rotating flyers, all of the flyers upon insertion of a suspension carriage train must be exactly so oriented that the rail segments in the flyers are flush with or aligned with one another or with the rail segments fixed on the flyer bank so that the tip of a suspension carriage train inserted into the flyer row can without problems transition between one rail segment and the next.

The flyers are form fittingly driven (i.e. coupled by cogged or toothed drives) to the extent that all of the flyers are brought with precision to standstill at the same orientation, i.e. transverse to the longitudinal axis. The individual flyers are thus at the correct angle so that their rail segments align with one another. When it is necessary to compensate for tolerances, the outer guide bodies, especially the rails, can widen in a funnel-shaped manner toward the suspension carriage train or inwardly lying guide bodies can be provided with centering guide cams which especially engage the front end of the loading carriage of a suspension carriage train.

For the reliability of the change process, i.e. the reliable insertion of the bobbin sleeves in the suspension holders or hangers or on the spool spindles, deviations of the angular positions of the flyers from a precise transverse positioning, can have no negative affect when the support means on the carriages of the suspension carriage train are advantageously coaxial with the hangers.

Since the replacement process allows the suspension carriage train to be longitudinally adjusted, the hangers can also be adjusted in the plane of the flyers using the support means. A rail is provided in this plane on the flyers and also along the axes of the flyers and the bobbins when the angular positions of the flyers deviate from their setpoint positions.

Since a continuous rail path is not possible in the position of the guide path for a suspension carriage train which is typical according to the invention, although the carriages of the suspension carriage train extend along the guide path, the guide means can be formed as supports upon which channels of the carriage bodies ride. This can be advantageous since it allows the use of the carriage bodies as rail structures which can be of considerable significance in the latter case. The guide means which are affixed at the undersides of the flyer bank can also be provided with support means on which the channels of the carriages ride. To improve the guidance of the suspension carriage train in this embodiment, two or more such support means can be provided in spaced relationship with one another transversely of the longitudinal direction.

The construction according to which the guide means are arranged on the flyers on rotationally symmetrical pins on which the flyers are mounted, permits a suspension carriage train to travel along the track in all angular positions of a flyer. It will be apparent that the flyers must be oriented approximately transversely to the longitudinal direction of the machine since only in this position will a clearance be provided which will enable the passage of the ,suspension carriage train with full roving bobbins through the interiors of the flyers. This configuration of the guide means permits, however, wide tolerances with respect to the cross section to form the rails.

A thickening of the pin so that it has a head enables the head to serve as a slide body. A cup-shaped slide body allows swinging of the suspension carriage train. When this is to be avoided, tightly fitting surfaces are used in which the guide channel will form-fittingly engage around the slide body. The sliding friction between the plurality of slide bodies which can become substantial especially when a significant number of heavy full roving bobbins are carried by the suspension carriage train can be reduced by appropriate selection of the materials of the sliding surfaces of the guide channel and the slide block and especially significant reduction in the friction can be had by providing the friction as rolling friction When only pin-shaped nondirectionally stable guidance of the guide means is provided, appropriate means must be afforded to insure that especially the first carriage of a suspension carriage train to be inserted will reliably pass from one pin to the next pin and that the subsequent carriage will not sag. When the coupling between the carriages is universally movable, because the suspension carriage train must, for example, travel not only along horizontal curves but also must change levels, this can be achieved only by making the carriages sufficiently long that they always bridge at least two pins.

Long carriages, however, increase the radius of curvature of curved travel which may be undesirable in the spinning mill and in many cases is not possible. When the carriages are coupled so that they can swing about vertical pivot axes only in a horizontal plane at least the two first carriages can be rigidly connected together for the suspension carriage train, to a carriage of greater length.

In a first embodiment at the inlet location of a suspension carriage train in the roving frame, a horizontal flat steel band is fitted into the suspension carriage train that stiffens the latter against movement transverse to its direction of movement. In another embodiment at least between the two first carriages of a suspension carriage train a lock or latch is provided upon insertion of the suspension carriage train in the roving frame which holds the two carriages in stable orientation with one another.

Present-day sleeves for roving frames have at their upper ends a tubular constriction which serves in the roving frame for radial guidance of the sleeve and whose lower shoulder in the pitch of the ring spinning frame provides an indexing for the hangers. To enable the hangers of the present invention also to be inserted into the sleeves, including the sleeves which are seated on the bobbin spindles of the roving frame, the known sleeves can be provided with two tubular constrictions one above the other, the lower forming the guide for the sleeve on the bobbin spindle while the upper serves as the indexing for the hanger.

The suspension carriage train can, as is known per se, have a number of hangers insertable into a row of flyers which is twice the number of bobbins or sleeves and flyers and thus spaced at half the pitch of the bobbin in the bobbin bank.

The method can then comprise the steps of:

(a) upon completion of roving bobbins on the roving frame, fully lowering the bobbin bank and setting flyers of the flyer bank transverse to a longitudinal machine axis;
(b) feeding a suspension hanger train into the flyer bank through the flyers and with a number of hangers twice that of the number of bobbins in corresponding lengths of the train and bobbin bank and with empty sleeves on alternate ones of the hangers;
(c) aligning hangers of the train with hangers free from sleeves and raising the bobbin bank to transfer full bobbins from the bobbin bank to the hangers free from sleeves;
(d) lowering the bobbin bank;
(e) displacing the train so that hangers with empty sleeves are aligned with spindles of the bobbin bank from which full bobbins have been transferred;
(f) raising the bobbin bank to transfer the empty bobbins from the hangers to the spindles;
(g) lowering the bobbin bank; and
(h) displacing the train with the full bobbins thereon out of the flyers.

This embodiment facilitates replacement of the bobbin by sleeves.

In a system in which the bobbin of the bobbin bank have a comparatively small pitch, the suspension carriage train can have a number of hangers equal to the number of flyers, bobbins or sleeves of the respective row. The method here can comprise the steps of:

(a) upon completion of roving bobbins on the roving frame, fully lowering said bobbin bank and setting flyers of said flyer bank transverse to a longitudinal machine axis;
(b) feeding a suspension hanger train into said flyer bank through said flyers and with a number of hangers equal to that of the number of bobbins in corresponding lengths of the train and bobbin bank;
(c) aligning hangers of said train with hangers free from sleeves and raising said bobbin bank to transfer full bobbins from said bobbin bank to said hangers free from sleeves;
(d) lowering said bobbin bank;
(e) displacing said train out of said flyers;
(f) feeding a suspension hanger train into said flyer bank through said flyers and with a number of hangers equal to that of the number of bobbins in corresponding lengths of the train and bobbin bank and with the hangers fitted with empty roving sleeves;
(g) aligning hangers with empty sleeves with spindles of said bobbin bank from which full bobbins have been transferred;
(h) raising said bobbin bank to transfer said empty bobbins from said hangers to said spindles;
(i) lowering said bobbin bank; and
(j) displacing said train from which said empty sleeves have been transferred out of said flyers.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
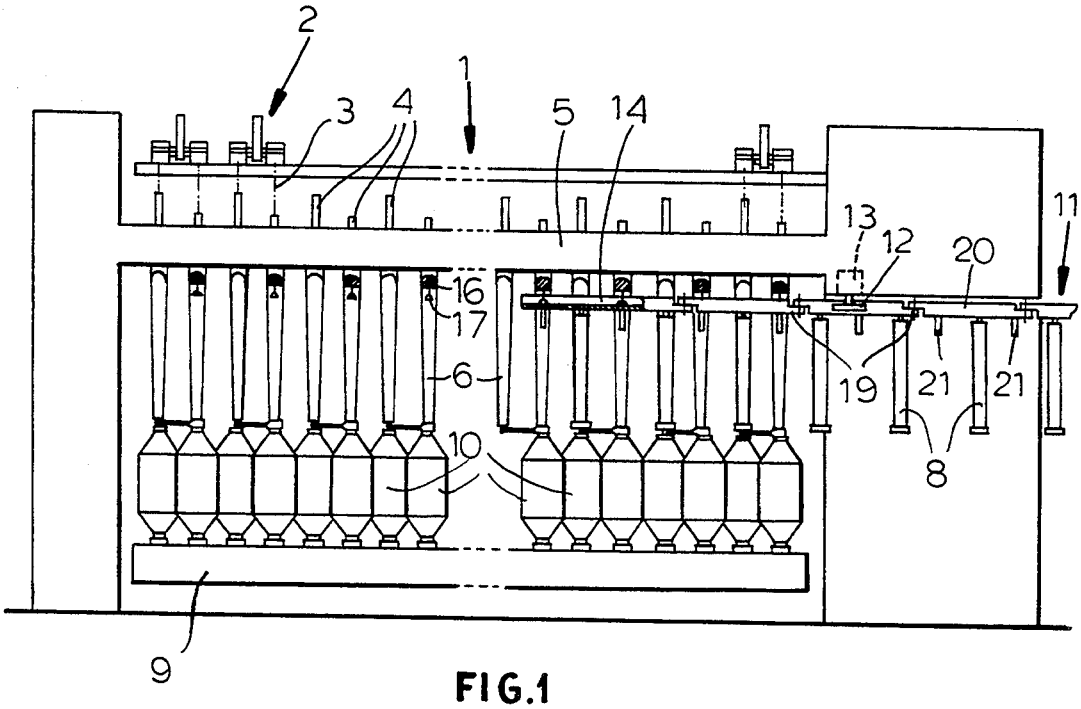
FIG. 1 is an elevational view of a roving frame with partly broken away flyer arms.

The roving frame 1 of the drawing has a drawing frame 2 from which the stretched sliver 3 is supplied via the inlet tubes 4 to the flyers 6 journaled in a flyer bank 5. The rovings formed by rotation of the flyers 6 pass through respective arms of the flyer and are guided via press fingers 7 onto the bobbin sleeves 8 on which they are wound to the turns of the bobbin 10 by the speed difference between flyer and bobbin sleeve and the up and down movement of the bobbin bank 9 carrying the bobbin sleeves. The elements for driving the flyers 6 and the bobbin spindles carrying the bobbin sleeves, as well as those for the up and down movement of the bobbin bank are known and thus are here neither shown nor described in detail. However, the flyers may be coupled positively with one another so that on standstill they assume the same angular positions.

Figure 2:
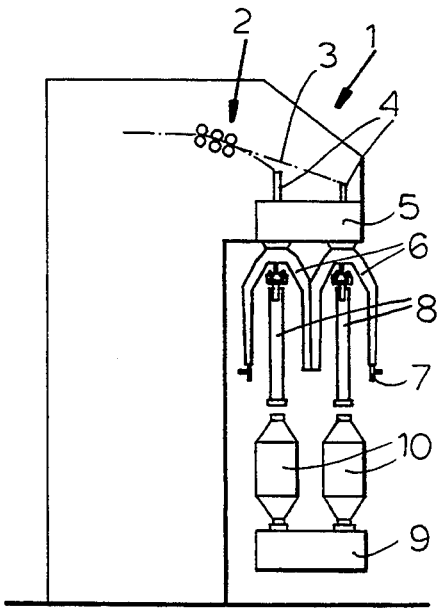
FIG. 2 is a cross section through a roving frame with the suspension carriage train inserted.

In the working phase illustrated in FIGS. 1 and 2, the roving bobbins are completed, the bobbin bank is lowered into the lowest position and the flyers 6 are disposed transversely to the longitudinal axis of the roving frame.

From the right to the left a suspension carriage train is shoved into the roving frame by means of a pair of friction rollers spring loaded against opposite side flanks of the carriage of the suspension carriage train.

Figure 5:
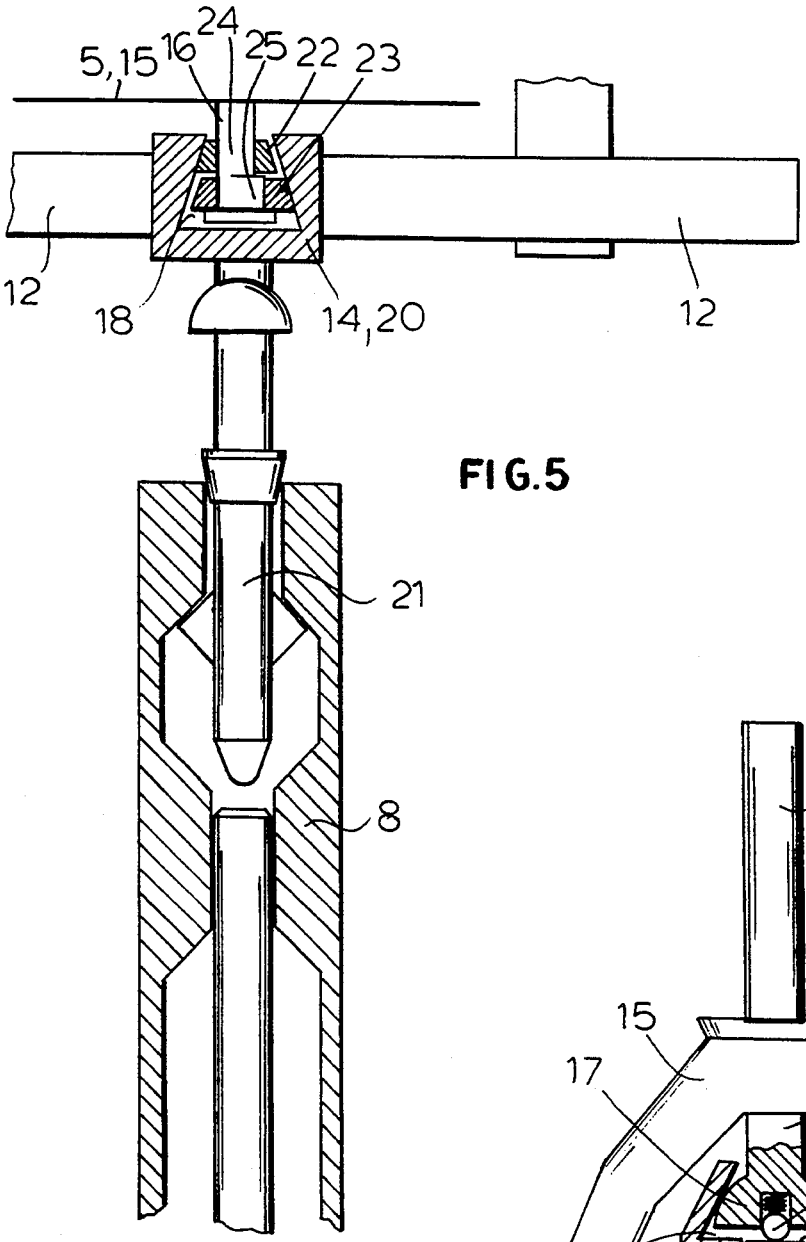
FIG. 5 is a cross section through another embodiment of the train.
Figure 6:
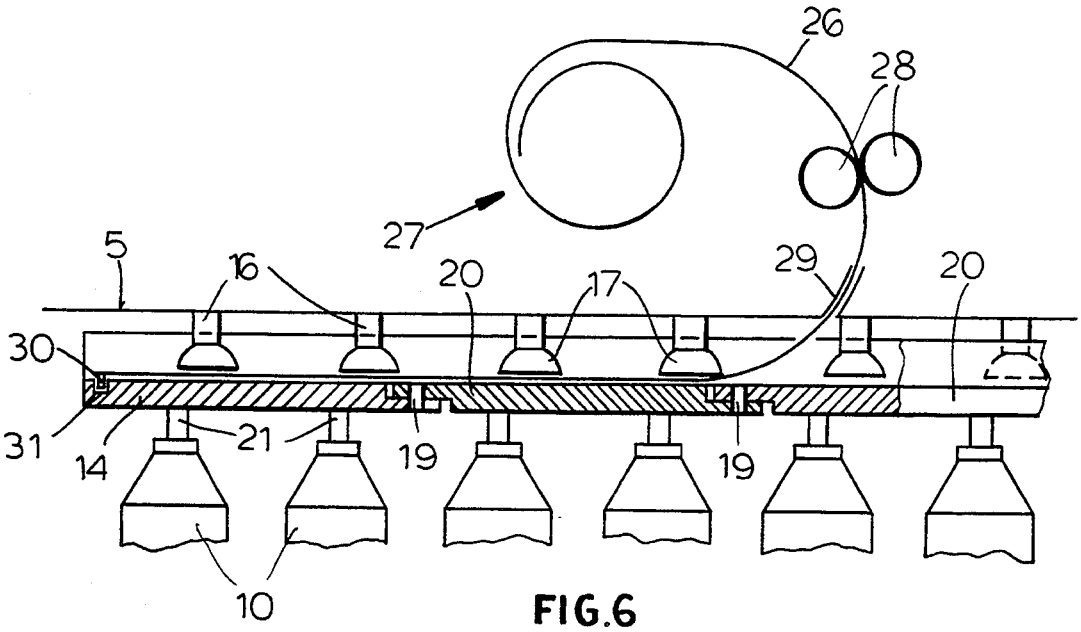
FIG. 6 is a detail of the invention in partly sectioned elevation.

At least one of these rollers is drivable by means of a motor 13 and the train is introduced into the first row of flyers. The front side of the first carriage 14 and the foremost flyer arms of the flyer 6 of the front flyer row of the roving frame 1 having two rows of flyers, are partly broken away to enable the guiding of the suspension carriage train 11 to be discerned. This guide is effected by means formed on the underside of the flyer heads 15, better seen from FIG. 4, of guide means which here is configured as pedestals 17 supported by holding pins 16 and by means of a dovetail like guide channel 18 in suspension carriages 14. The guide can also be formed by the same pins on the bank 5 directly (FIGS. 5 and 6).

The individual carriages 14, 20 of the suspension carriage train 11 are connected via pivot axes 19 with one another so as to be at least laterally movable and have, at a spacing of half the spacing of the flyers of this flyer row, hangers 21 of conventional construction which, upon pressing into the tubular bobbin sleeves 8, alternatingly engage and release these bobbin sleeves. Each second hanger 21 is fitted with an empty sleeve 8.

When both suspension carriage trains are inserted below both flyer rows of the roving frame completely, above each full bobbin 10 there is disposed an empty hanger 21 (FIG. 2).

Figure 3:
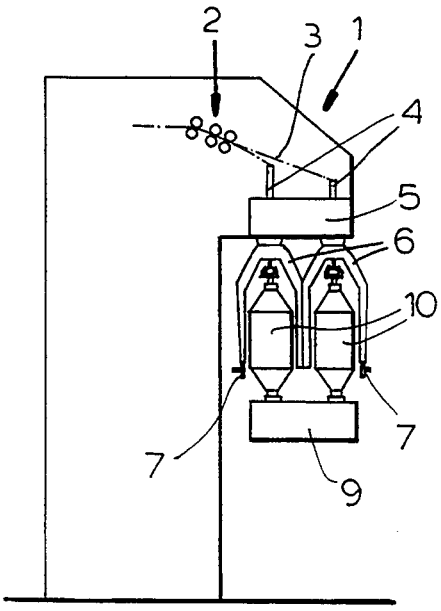
FIG. 3 is a cross section through the roving frame with raised bobbin bank.

When the bobbin bank 9 is then raised into the position illustrated in FIG. 3, these hangers 21 insert into the bobbin sleeves 8 of the bobbins 10 and engage them (FIG. 3) so that upon the subsequent lowering of the bobbin bank, the bobbins 10 remain suspended from the suspension carriage train. Then the suspension carriage train is shifted by a distance equal to the spacing between its hangers 21 so that a respective empty sleeve 8 is aligned above each bobbin spindle. When the bobbin bank 9 rises again into the position of FIG. 3, these empty sleeves are released from their hangers and remain during the downward movement of the bobbin bank upon the bobbin spindles. This completes the replacement process and the suspension carriage train can, with the suspended full bobbins 10, be fed out of the roving frame by means of the friction roller pair 12.

The suspension carriage trains can be provided in the cross bar pattern and spacing (bobbin pitch) of a roving spinning machine and can be fed to the latter and there held in preparation. Since, however, the spacing of the spindles on the roving frame and the spacing of the feed bobbins on the cross bars of a roving spinning machine do not coincide, the roving spindles as a rule may have to be rehung with a different spacing in the suspension carriage train or otherwise handled.

Upon removal of the full bobbins, the suspension carriage train is fitted again with empty sleeves and thus stands ready for the next replacement process at this or another roving frame.

In the embodiment of FIGS. 1 to 4, the guide means [for the suspension carriage train] are arranged below the flyer heads 15. They are provided as rotationally symmetrical parts which can support the suspension carriage trains in all angular positions of a flyer to serve as guides.

To reduce the frictional resistance or the sliding friction between the multiplicity of pedestals 17 and the guide channels 18 as much as possible, the surfaces which slide on one another are provided from materials with reduced friction coefficients, e.g. polytetrafluoroethylene or molybdenum sulfide.

To enable the sliding friction to be replaced by rolling friction, the pedestals 17 can be replaced by rollers.

FIG. 5 shows an embodiment in which the two frustoconical rollers 22 and 23 are journaled at laterally offset journal segments 24, 25 of the support pin 16. This enables the two rollers 22, 23 to lie against and roll upon opposite sides and guide flanks of the guide channels 18 of the carriages 14, 20 of the suspension carriage train 11.

Figure 4:
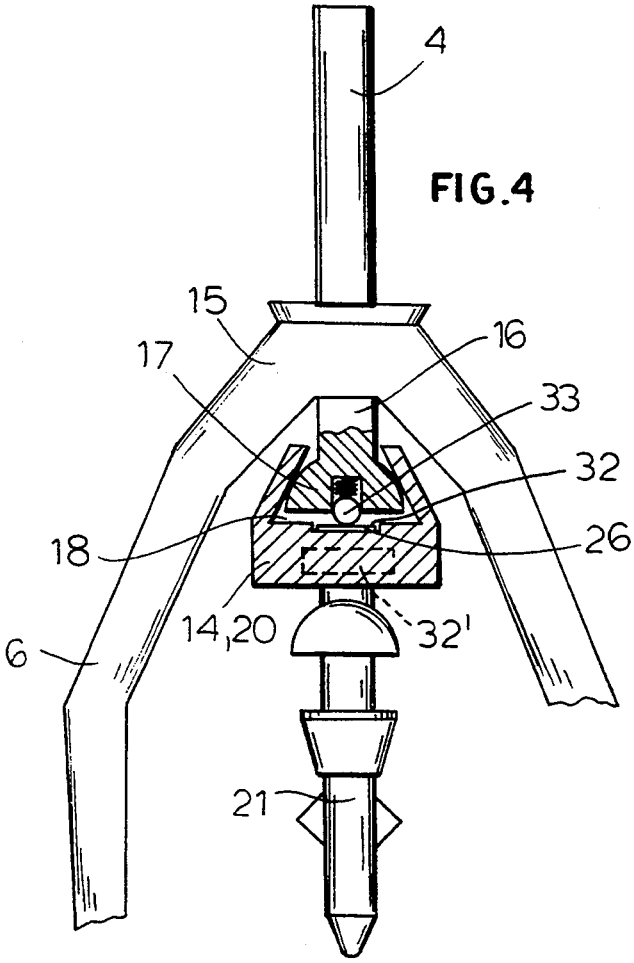
FIG. 4 is a partly sectioned illustration proximal to the flyer of the embodiment of FIGS. 1-3.

While guide flanks in both embodiments shown in FIGS. 4 and 5 form the dove-tail guide channel, respective outer flanks of the carriage 14, 20 in FIG. 4 converge to one another and respective outer flanks of the embodiment seen in FIG. 5 are parallel to one another.

In providing the guide means as pins according to FIGS. 1 to 5, especially the first carriage 14 of a suspension carriage train 11 introduced into a flyer row must be able to bridge a greater distance between the guide means of successive flyers for a reliable engagement with each successive pin.

To insure this, as can be seen from FIG. 6, at the inlet location of the suspension carriage train 11 into the row of flyers, a thin flexible steel band 26, which, as has been shown, can be formed by a rolled up band, is laid into the carriages 14, 20 of the suspension carriage train. The steel band 26, when it is not required, is rolled up in a spiral 27.

When the suspension carriage train is inserted, the steel band is laid in synchronously with the movement of the suspension carriage train fed by means of a drivable feed roll pair 28 through a guide passage 29 into the suspension carriage train, whereby its leading end is anchored by means of a pin 30 in a recess 31 of the first carriage 14 of the suspension carriage train.

Since the steel band cannot be wider than the open width of the guide channels 18 of the suspension carriage train, the open width of these channels at the level at which the steel band 26 is inserted can be increased as shown in FIG. 4 where a groove 32 of the width of the steel band is provided and in which the steel band can be seated.

Through the use of securing elements, for example, in the form of ball pressing elements 33 at the underside of the pedestals 17 or—as has been shown in dot-dash lines at 32' with magnets in the groove 32, undesired lifting of the steel band 26 from this groove is prevented.

Figure 7:
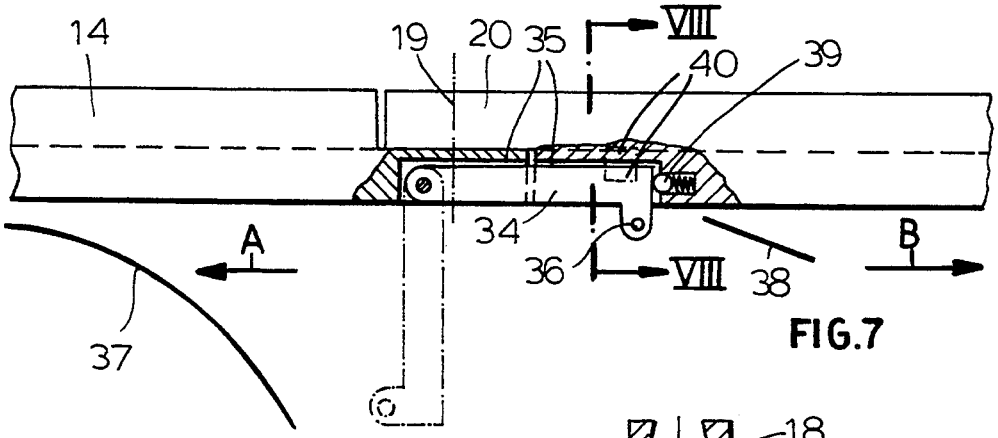
FIG. 7 is a further detail of the invention in partly sectioned elevation.
Figure 8:
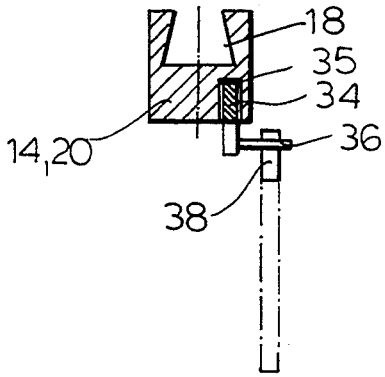
FIG. 8 is a cross sectional view through FIG. 7 along line VII—VII thereof.

FIGS. 7 and 8 show another possibility in which in a leading carriage 14 of a suspension carriage train 11, a latch 34 is swingably journaled which can engage in a groove 35 dimensioned to receive it of a subsequent carriage 20. The latch 34 has a laterally projecting pin 36 which can engage guide rails 37 and 38 at the inlet location of the suspension carriage train 11 into the roving frame. The latch 34 is provided with retaining means in the form of a ball pressure detent 39 or, as signified by dot dash lines, a pair of magnets 40 which hold the latch releasably in the indicated locking position.

Upon insertion of the suspension carriage train 11 into the roving frame 1 in the direction of arrow A, the pin 36 slides in the dot dash line position of the downwardly hanging latch 34 upon the guide rail 37 which lifts the latch into the solid line locking position in which the two carriages 14 and 20 are rigidly connected together and held by the retaining means 39 and 40.

Figure 9:
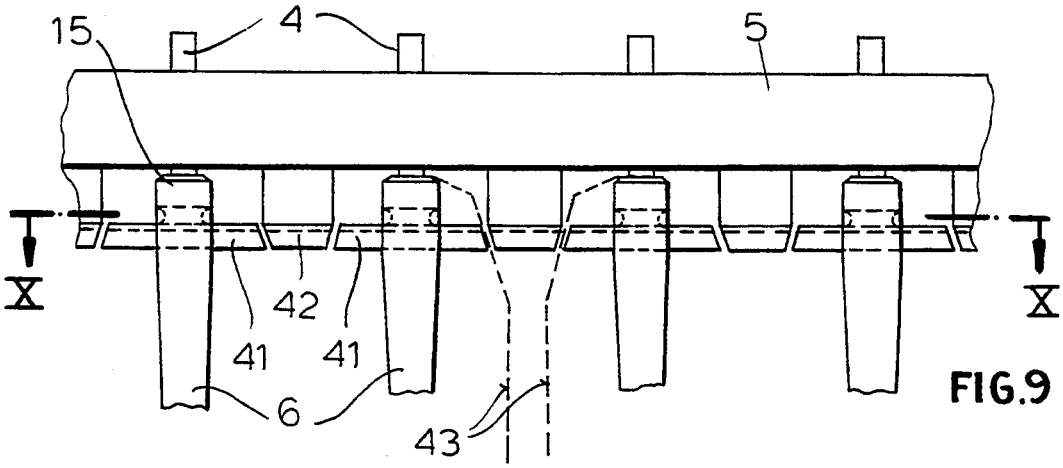
FIG. 9 is an elevation of another embodiment of the suspension carriage guide.
Figure 10:
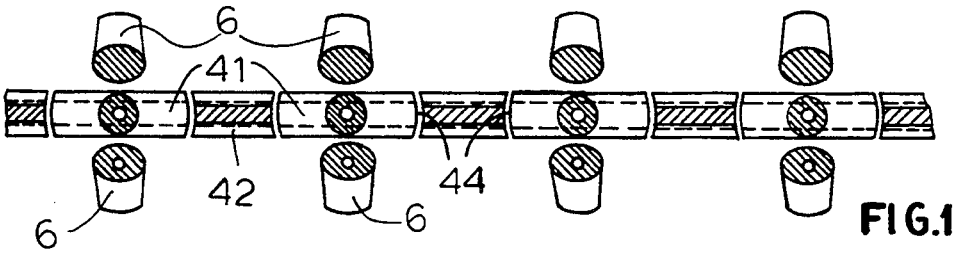
FIG. 10 is a section along line IX—IX of FIG. 9.

Upon withdrawal of the suspension carriage train 11 from the roving frame 1 in the direction of arrow B, the pin 36 rides against the guide rail 38 which pulls loose the latch 34 and disconnects the two carriages 14 and 20. FIGS. 9–15 show embodiments in which the guide means are formed as rail segments 41, 42, in or on which carriers of the carriages 14, 20, for example, in the form of rollers, are guided. In the embodiment of FIGS. 9 and 10, the rail segments 41, 42 are arranged under the heads 15 of the flyers 6 as well as along the underside of the flyer bank 5. The rail segments extend close to the boundary of the movement space 43 of the flyer 6 indicated in broken lines. As is especially apparent from FIG. 10, the rail segments 42 arranged beneath the flyer bank 5 and the rail segments 41 under the flyer heads 15 of the flyer 6 in positions of the flyers transverse to the longitudinal axis of the roving frame 1, in cooperation from a continuous guide track indicated in broken lines with only minimal gaps 44 and along which the respective suspension carriage train can be guided with absolute orientation stability.

Figure 11:
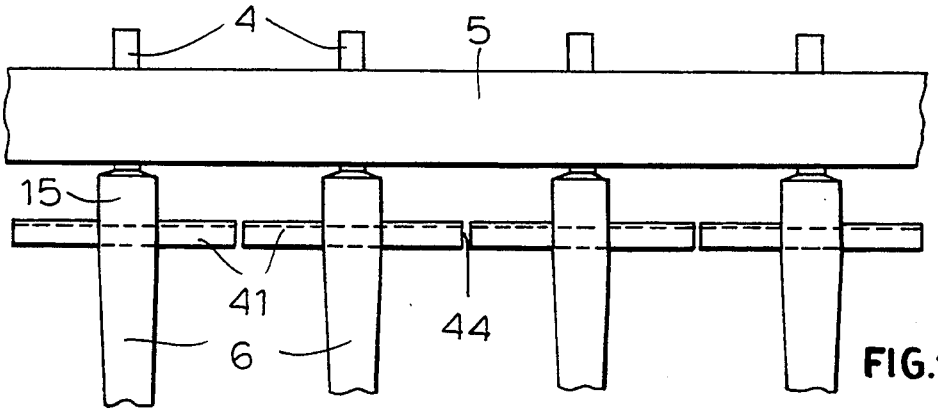
FIG. 11 is an elevation of another embodiment of the suspension carriage guide.
Figure 12:
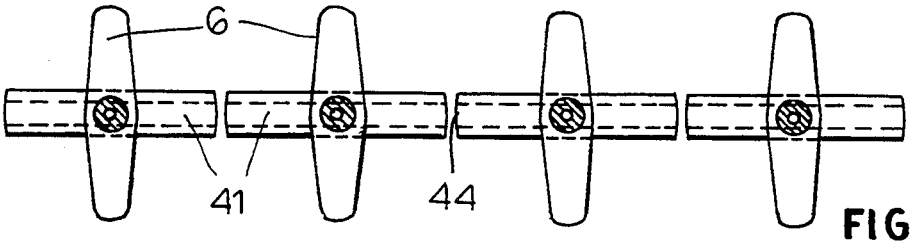
FIG. 12 is a section along line XII—XII of FIG. 11.
Figure 13:
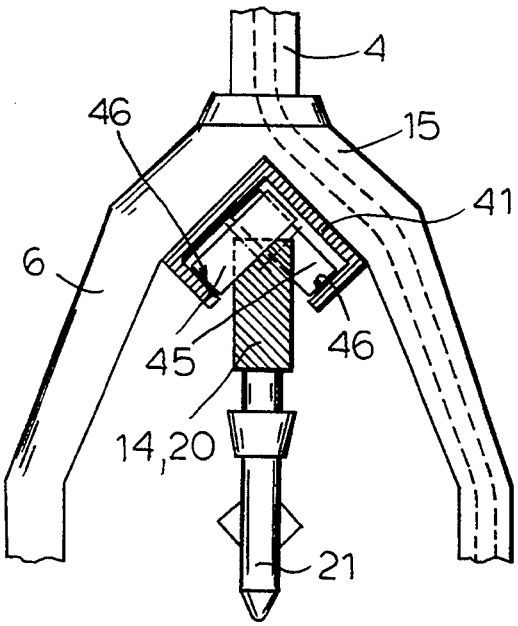
FIG. 13 is a partial section as in FIG. 4 of another embodiment.
Figure 14:
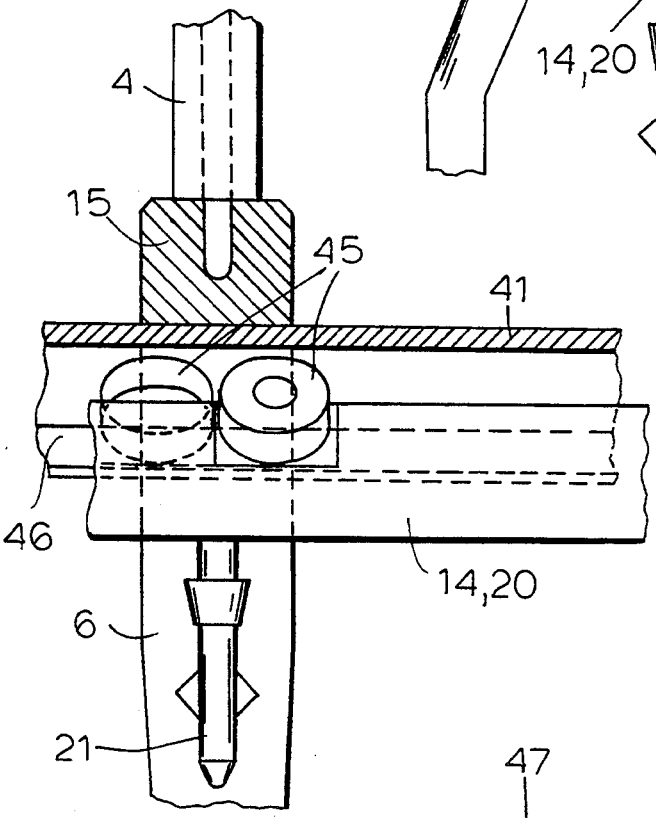
FIG. 14 is a partially sectioned elevation of the subject of FIG. 13.

In the embodiment of FIGS. 11 and 12, the guide means is in the form of rail segments 41 only below the flyer heads 15 of the flyers 6. As can be seen, these rail segments, in transverse positions of the flyers 6, apparent from the illustration, also form a practically gap free guide track. For feeding the train onto these rail segments 41, 42, as is shown in FIGS. 13 and 14 the carriages 14, 20 of the suspension carriage train 11 have support elements in the form of rollers 45 with horizontal axes or with axes which are inclined, as shown, which roll upon the guide services 46 of the rail segments 41, 42.

Figure 15:
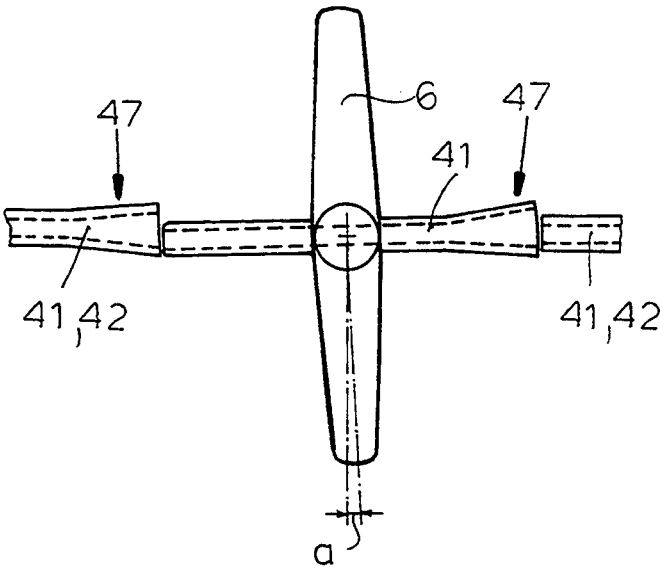
FIG. 15 is a plan view of a detail of a flyer of the invention.

To compensate for slight deviations from the flyer 6 from their transverse positions by, for example, an angle a, at which the rail segments 41 of the flyers do not align exactly, at the transition of the carrier 45 to these rail segments, alignment is effected by equipping these rail segments 41, 42, as is apparent from FIG. 15, at their inlet sides 47 with funnel-shaped enlargements.

Figure 16:
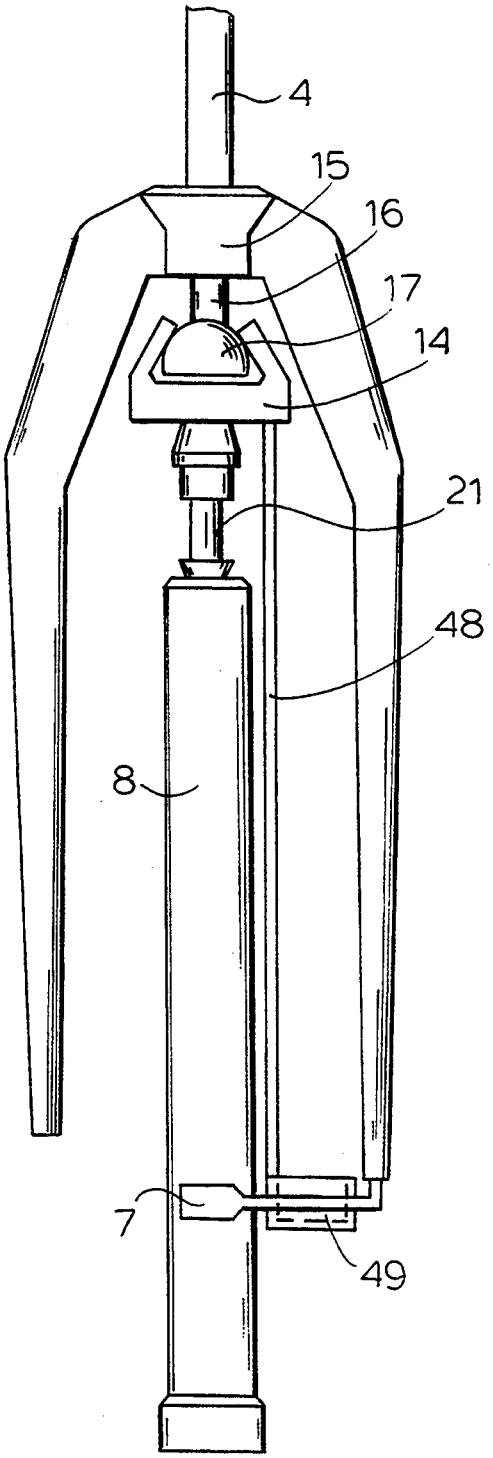
FIG. 16 is an elevation of an end of a suspension carriage train.
Figure 17:
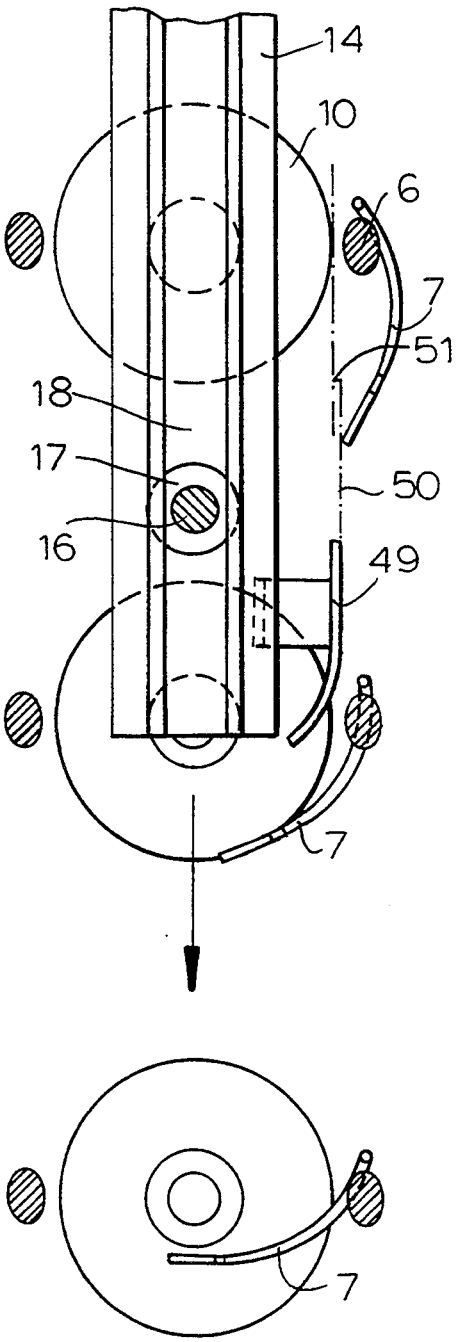
FIG. 17 is a plan view of the subject of FIG. 16 with parts partly broken away.

So that the pressing fingers 7 can remain in defined positions after the standstill of the roving frame, outside the path of the suspension carriage train 11 onto which the full bobbins 10 are attached, the first carriage 14 of the suspension carriage train, as is apparent from FIGS. 16 and 17 is equipped on a support rod 48 with a deflector rail 49 which, upon feeding of the suspension carriage train in the direction of the arrow, presses the pressing finger 7 behind a plane 50 to a side so that the pressing finger will be disposed outside the planes 50, between which the full bobbins of the suspension carriage train can move.

The deflector rail 49 cooperates with the pressing finger arrangement only in the indicated movement direction of the suspension carriage train 11. To the extent that the flyers 6 are in the other flyer row of the roving frame and are offset by about 180° as is customary, the suspension carriage train can be introduced into this row of flyers from the other side.

Figure 18:
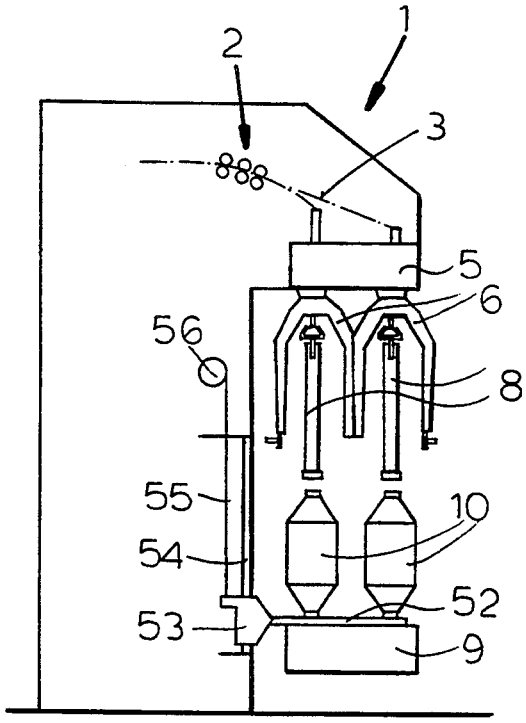
FIGS. 18 and 19 are end views in elevation as in FIGS. 2 and 3 of a variant.
Figure 19:
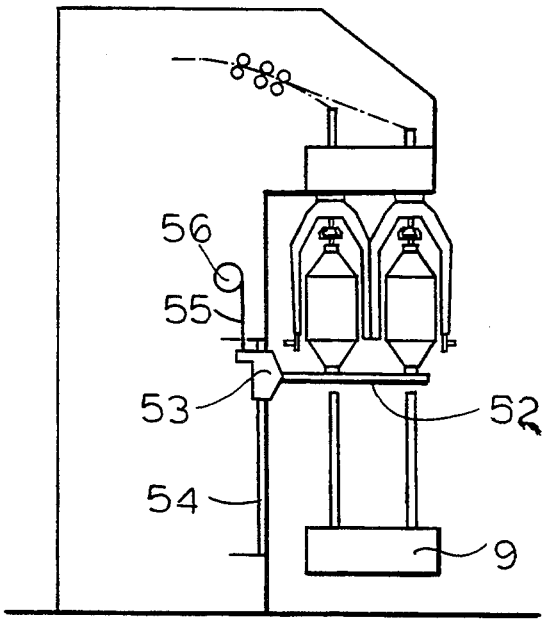

As an alternative to the described embodiment, in which the vertical movement of the bobbins 10 or sleeves 8 is effected between the bobbin takeups in the bobbin bank 9 and the hangers 21 in the suspension carriage train is effected by the up and down movement of the bobbin bank, FIGS. 18 and 19 show an embodiment in which, for this purpose, a separate device from the bobbin bank is provided, this device being separately movable.

This device comprises a table 52 which is guided by means of slides 53 on vertical columns 54. It lies in the plane of the feet of the bobbins 10 or sleeves 8 and engages beneath these feet or can be provided with resilient or other means forming working elements which are not further described, such as tongs to engage these feet.

During the normal operation of the roving frame the table 51 rests on the bobbin bank and moves therewith up and down.

After completion of the bobbins 10 of the bobbin bank 9, the latter is lowered as is shown in FIG. 18 and the table engages the full bobbins and with the aid of a traction element 55 and a roller 56 for this element which is driven and controlled by means not shown, the table is drawn upwardly until the full bobbins are suspended in the hangers 21. Then the table 52 is lowered sufficiently so that the shifting or displacement and insertion and withdrawal of the suspension carriage train is not hindered.

Through the corresponding up and down movement of the table the empty sleeves 8 of the hangers 21 of the suspension hanger train 20 can be removed and seated on the bobbin takeups of the bobbin bank 9.

What is claimed is:

1. A roving frame, comprising:

a horizontal flyer bank extending longitudinally along a horizontal machine axis and provided with a row of flyers journaled for rotation below said flyer bank about respective vertical axes uniformly spaced apart along said flyer bank, each of said flyers being rotatable through a respective region of rotation thereof and spinning sliver into rovings;

a horizontal spindle bank below said flyer bank and provided with respective horizontally spaced vertical spindles for receiving empty roving sleeves and winding up said rovings thereon to form full bobbins;

guide means on said flyer bank including guide elements oriented parallel to said horizontal machine axis for forming a guide track along said horizontal machine axis;

a suspension carriage train guidable onto and along said track;

a plurality of hangers suspending from said train and extending through said regions of rotation upon displacement of said train along said track, said hangers being alignable with said spindles for selectively receiving said full bobbins from said spindles and transferring empty sleeves to spindles from hangers of said train; and means on said spindle bank for raising full bobbins to selected ones of said hangers and lowering empty sleeves from selected ones of said hangers.

2. The roving frame defined in claim 1 wherein at least some of said guide elements are arranged on an underside of said flyer bank.

3. The roving frame defined in claim 1 wherein at least some of said guide elements are arranged on undersides of heads of said flyers between arms thereof.

4. The roving frame defined in claim 1 wherein said guide track is rail segments on which carriers of the suspension carriage train are guided.

5. The roving frame defined in claim 1 wherein said guide elements are pins received in channels formed in carriages of said train.

6. The roving frame defined in claim 5 wherein said pins formed on undersides of heads of said flyers along the respective vertical axes and having enlargements received in the channels of said carriages.

7. The roving frame defined in claim 6 wherein said enlargements are pedestal-shaped bodies sliding in said channels.

8. The roving frame defined in claim 6 wherein said enlargements are rollers offset transversely of said horizontal machine axis and axially from one another.

9. The roving frame defined in claim 6 wherein said channels are dovetail shaped and converge upwardly.

10. The roving frame defined in claim 1 wherein said train has a first two carriages in a direction of insertion of said train onto said track, said train further comprising a coupling member rigidly connecting said first two carriages with one another in a horizontal plane.

11. The roving frame defined in claim 10 wherein said coupling member is formed by a flat rigid metal band bendable in a vertical plane and rigid in a horizontal plane, insertable into said first two carriages upon insertion of said train onto said track and withdrawable upon withdrawal of said train from said track.

12. The roving frame defined in claim 10 wherein said coupling member is a rigid lock swingably mounted on one of said first two carriages and engaging the other of said first two carriages upon insertion of said train onto said track and retractable upon withdrawal of said train from said track.

13. The roving frame defined in claim 1 wherein each spindle is provided with a pressing finger for pressing roving onto the respective bobbin, said roving frame further comprising a deflection rail on said train for deflecting each pressing finger out of a path of full bobbins upon movement of said train along said track.

14. The roving frame defined in claim 1 wherein said means for raising full bobbins and for lowering empty sleeves includes a device disposed between said bobbin bank and said flyer bank and raisable and lowerable to lift said bobbins from said bobbin bank and lower said sleeves onto said bobbin bank.

15. The roving frame defined in claim 1 wherein said means for raising full bobbins and for lowering empty sleeves includes a bobbin bank which is raisable and lowerable relative to said track.

16. A method of operating a roving frame for automatic replacement of full bobbins with empty roving sleeves wherein a bobbin bank is located beneath a flyer bank, said method comprising the steps of:

(a) upon completion of roving bobbins on the roving frame, fully lowering said bobbin bank and displacing flyers of said flyer bank transverse to a longitudinal machine axis;

(b) feeding a suspension hanger train into said flyer bank through said flyers and with a number of hangers twice that of the number of bobbins in corresponding lengths of the train and bobbin bank and with empty sleeves on alternate ones of said hangers;

(c) aligning hangers of said train with hangers free from sleeves and raising said bobbin bank to transfer full bobbins from said bobbin bank to said hangers free from sleeves;

(d) lowering said bobbin bank;

(e) displacing said train so that hangers with empty sleeves are aligned with spindles of said bobbin bank from which full bobbins have been transferred;

(f) raising said bobbin bank to transfer said empty bobbins from said hangers to said spindles;

(g) lowering said bobbin bank; and (h) displacing said train with said full bobbins thereon out of said flyers.

17. A method of operating a roving frame for automatic replacement of full bobbins with empty roving sleeves wherein a bobbin bank is located beneath a flyer bank, said method comprising the steps of:

(a) upon completion of roving bobbins on the roving frame, fully lowering said bobbin bank and displacing flyers of said flyer bank transverse to a longitudinal machine axis;

(b) feeding a suspension hanger train into said flyer bank through said flyers and with a number of hangers equal to that of the number of bobbins in corresponding lengths of the train and bobbin bank;

(c) aligning hangers of said train with hangers free from sleeves and raising said bobbin bank to transfer full bobbins from said bobbin bank to said hangers free from sleeves;

(d) lowering said bobbin bank;

(e) displacing said train out of said flyers;

(f) feeding a suspension hanger train into said flyer bank through said flyers and with a number of hangers equal to that of the number of bobbins in corresponding lengths of the train and bobbin bank and with the hangers fitted with empty roving sleeves;

(g) aligning hangers with empty sleeves with spindles of said bobbin bank from which full bobbins have been transferred;

(h) raising said bobbin bank to transfer said empty bobbins from said hangers to said spindles;

(i) lowering said bobbin bank; and (j) displacing said train from which said empty sleeves have been transferred out of said flyers.

* * * * *